United States Patent [19]

Dulin

[11] Patent Number: 5,076,490

[45] Date of Patent: Dec. 31, 1991

[54] COMBINATION INDEX CARD/POST CARD

[76] Inventor: Jacques M. Dulin, 16310 Jackson Oaks Dr., Morgan Hill, Calif. 95037

[21] Appl. No.: 569,918

[22] Filed: Aug. 20, 1990

[51] Int. Cl.[5] ..... B42D 15/02

[52] U.S. Cl. ..... 229/92.8; 40/360; 40/404; 402/79

[58] Field of Search ..... 229/92.8; 402/79, 500; 40/360, 404; 281/38

[56] References Cited

U.S. PATENT DOCUMENTS

| | | | |
|---|---|---|---|
| 2,616,612 | 11/1952 | Guttman . | |
| 2,708,068 | 5/1955 | Guttman . | |
| 2,805,816 | 9/1957 | Morgan . | |
| 3,930,700 | 1/1976 | Figueres | 281/38 X |
| 3,970,397 | 7/1976 | Armstrong . | |
| 4,167,241 | 9/1979 | Zumbrunn . | |
| 4,237,633 | 12/1990 | Murrell . | |
| 4,849,056 | 7/1990 | Ristuccia, Sr. . | |
| 4,957,311 | 9/1990 | Geisenheimer | 229/92.8 X |

FOREIGN PATENT DOCUMENTS

| | | | |
|---|---|---|---|
| 366322 | 10/1906 | France | 281/38 |
| 79498 | 12/1918 | Switzerland | 281/38 |
| 19111 | of 1908 | United Kingdom | 281/38 |

*Primary Examiner*—Stephen P. Garbe
*Assistant Examiner*—Jes Pascua
*Attorney, Agent, or Firm*—The Dulin Law Firm

[57] ABSTRACT

Combination mailer comprising postcard-weight stock having therein at least two areas, a first right hand area for an address and postage and a left hand area which includes a partially perfed (die cut) index card which may be removed from the combination mailer. The index cards may be standard small size or a larger size depending on the size of the mailable card used. The index card may be oriented horizontally or vertically. A vertical boundary between the left and right side areas is defined by a scoring, perf line, printed line or dashes in order to assist in removing the index cards from the mailer. Only partial perforations are used to define the index card margins to prevent the mailer from being folded, mutilated, lost or delayed in the mailing. Microperfs are preferred. Preferably, the index card is oriented vertically with only the T-shaped notches along the bottom margin being perfed out, leaving the bottom margin or top margin to be cut with scissors. A tab can also be defined by perfs inset from the top edge of the index card. Preferably the card stock is paper, plasticized paper or plastic, and may be in bright or neon colors. The combination mailers may be printed "four-up" on standard 8½"×11" sheet and may be removed from the sheet along a single horizontal and a single vertical line. This orientation of the index card in the postcard permits preprinting the sender's information regarding its business on the index card along with a promotional message on the back side of the mailer correlating to the address portion. Auxiliary information regarding the sender's business may be provided on the back side of the index card, or may be left blank for the user. This permits mailing the index cards at a lower postal card rate, and obviates all the costs of envelopes accompanying letters, collating and stuffing of full sized envelopes.

27 Claims, 2 Drawing Sheets

COMBINATION INDEX CARD/POST CARD

FIELD

This application relates to a specially designed index card of the type known as a ROLODEX brand index card, portions of which are die cut into and removable from a post card, with the orientation of the index card in the post card being specially selected to prevent the index card from becoming detached during transport in the mails, while providing room for address information, postage and a promotional message on the balance of the post card.

BACKGROUND

Rotary, arcuate and linear index cards holders have been available for a number of years. The cards for these holders typically have one or two T-shaped notches in the bottom edge to engage ribs in the card holders. The index mechanism may have these ribs oriented linearly, or they may be on a spool. The latter are commonly sold under the trademark ROLODEX.

These index cards come in a variety of sizes, typically four sizes: Small, 2⅛"×4"; Medium, 3"×5"; Large, 4"×6"; and X-large, 5"×8". Also, some of the cards have a raised tab along one of the upper edges to that the card is "flagged" as compared to other cards. The cards are of varying thickness and material. They can not be mailed by themselves, principally because their notched bottom edges would become torn or otherwise damaged in mail handling. In addition, those notches would be caught in and engaged with other mail, and become lost, delayed or mis-delivered. Further, there is no place on the cards to put postage, an address, and instructional or promotional information, while at the same time leaving space available for the information about the sender that is to be put on the index card itself.

Many companies find it helpful to provide their customers or potential customers with pre-printed index cards to save the recipient the time of properly inputting information on the cards. When that is left to the customer, often incorrect or obsolete information is placed on the cards. In addition, many companies find it of great help to flag their cards with bright colors or other devices so that they are easy to find.

Mail costs continue to escalate, not only as to the increased postage rates, but also in the handling machinery and the labor to collate, merge, stuff and address envelopes containing promotional material.

The current usual way to provide these index cards is to mail them along with some type of a promotional letter. Accordingly, the letter must be prepared, the index card prepared, the two items collated and merged for stuffing in an envelope, the envelope addressed and the postage applied. In addition, the postage required is that for a first class envelope as compared to a postcard, the differential of which is currently 8c. For companies having large mailings upon change of address, addition of staff, opening of new offices etc., that postage differential is very substantial. Further, the current need to include index cards with a full letter increases that cost differential substantially, considering the additional costs of the promotional letter, the envelope, the printing of both, and the collating, merging and stuffing costs.

Ristuccia U.S. Pat. No. 4,849,056 shows use of an index card formatting device having various slits, peel off adhesive strips, and window frame type holes for securing business cards thereto as a sales device to show prospective customers what their index card will look like when printed with their business card information. The window embodiment of FIGS. 6–11 is used as a formatting device or jig for the printer. Also shown incidentally in FIG. 15 (but not claimed) is preprinted rotary file index card with all margins defined by perforations and completely inset within the margins of what is described as a card "for example the size of a post card." This has the aforementioned difficulties, namely that the vertical right side perforation weakens the card so that if it were mailed (which is not disclosed) it could become bent in mailing. Likewise the complete, all around perfing has the disadvantage of the potential for the index card becoming separated (loose) during mailing, or the flap between the T slots engaging other mail or handling equipment thereby becoming damaged, delayed or lost in transit. The location and orientation of the card apparently does not provide sufficient room for an address and postage.

Armstrong U.S. Pat. No. 3,970,397 shows business information carried in a field the size of a standard business card (2"×3½") on a larger 3"×5" card. Multiple perforations, slots and holes are provided so the card may be used with any of several different card filing systems by tearing off the material that is excess for a particular filing system. Personal delivery of the compound "universal" card is disclosed (col. 2, lines 5–8).

Guttman U.S. Pat. Nos. 2,616,612 and 2,708,068 disclose a card, insertable in an envelope, for mailing a credit card which forms a separable corner of the insert card. The credit card portion is defined by perforations (the '612 patent) or one or more holes (the '068 patent) in the lower right corner of the insert. That credit card portion is also covered by a transparent protective sleeve which is secured to the insert card. The insert card is then stuffed in a special window-envelope so the name and address on the credit card is visible, saving addressing the envelope. The inserted card is not mailed by itself.

Morgan U.S. Pat. No. 2,805,816 shows a postal card-sized business mailing piece of laminated construction having a peel-off sticker on the back side. The sticker carries new address, phone number, etc. information.

Zumbrunn in U.S. Pat. No. 4,167,241 and Murrell in U.S. Pat. No. 4,237,633 show letter envelopes and mailing postcards for mailing photographs inserted or adhered thereto, which mailing device also serves as a stand for the photograph.

Accordingly, there is a need for a simple manner of getting index cards into the hands of customers and potential customers that is less handling and postage cost sensitive.

THE INVENTION

Objects

It is among the objects of this invention to provide an improved method of mailing index cards in a specially designed postcard format.

It is another object of this invention to provide a specially designed combination mailer piece comprising a postcard having a die cut index card oriented therein to permit postcard mailing without the index card falling out or the postcard folding and becoming damaged during the mailing operation.

It is another object of this invention to provide a specially designed postcard having one or more removable index cards die cut therein which are specially oriented to provide room not only for addressing and postage, but also for a promotional message.

It is another object of this invention to provide a specially designed index card/postcard combination mailer piece which can be provided four or more "up" on a single sheet of stock which is capable of being printed on one or more sides and perfed for easy separation into four or more mailable postcards.

Still other objects will be evident from the specification and drawings hereof.

DRAWINGS

The invention is illustrated by reference to the drawings in which:

FIG. 1A is a plan view of a combination mailer card of this invention from the front side oriented horizontally (normally) with address information on the right and a vertically oriented index card on the left;

FIG. 1B in the obverse side of the combination mailer card of FIG. 1A showing the ad message space on the left and the vertically oriented preprinted index card on the right;

SUMMARY

Figure 1A:
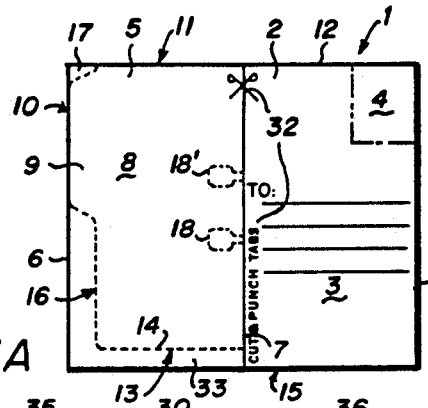

The invention comprises a specially designed combination mailer comprising a postcard having one or more perfed, die cut removable index cards disposed therein of the type having T-shaped notches along the bottom edge to engage index card holders, preferably of the rotary or arcuate type. The index cards are preferentially oriented with their typing axis 90° transverse to the normal typing axis of the postcard, and disposed on the left side of the postcard as seen from the front face. This orientation provides room on the face of the postcard for placement of the address of the addressee in the normal addressee position. It also provides room for a postage stamp or postage meter imprint in the proper postage position.

The index card may be defined by a perfed outline, preferably in microperfs which leave a substantially smooth edge. In the preferred embodiment, there is no perfing along the bottom of the card except for the T-shaped notched areas. Alternately, the T-shaped notches may be entirely removed leaving holes in the postal card. There is however, a printed or scored line defining the rest of the bottom edge of the index card along which the recipient can cut the bottom of the index card from the postcard of which it forms a part. The cuttable printed line may be either solid or dashed, and may include a small image of scissors by way of instruction.

The provision of perfs for the notches only in combination with a score or printed cut line which defines the bottom of the index card permits a simple straight cut to relieve the index card from the postcard without the disadvantage of having a vertical perf line completely up the postcard that would be a disadvantage in handling during mail transport. The presence of a perf line would provide a weakness in the postcard which could thereupon become easily folded and trapped in other mail resulting in it being lost, delayed or damaged. Perfing or completely die cutting out the hard to cut notches eliminates the difficult job of precisely cutting out notches; recipients simply could not be bothered cutting out notches.

The index card may have a variety of tab placements: left, center, or right, or no tab. The excess material defining the tab outline can be perfed for easy removal. There is no disadvantage if the perfed tab waste material is removed beforehand or lost in transit.

The transverse orientation of the index card also provides room for placing one or more promotional or informational messages on the postcard as well as the pre-printed index card of the sender which can be easily removed from the post card and inserted in the user's index card holder. For example, the information relating to the sender's business may be printed in the normal orientation on the index card, on either the side of the index card which forms the face side of the postcard, or on the obverse side. In either alternative, this information is oriented transverse to the normal orientation on the postcard portion of the combination mailer piece of this invention. Likewise, on the backside of the postcard there is room for a promotional message on the left, while the backside of the index card is now on the right.

If desired, the promotional message can extend across the entire back side of the postcard, where there is no disadvantage in having a transverse partial message on the back of the index card because that back side will not be used in the index. Alternatively, secondary information can be provided on the back side of the index card portion of the combined mailer piece of this invention (on the back side of the postcard). By way of example, the primary information may be on the front side of the index card (the front side of the postcard side) such as the main office, whereas the back side of the index card can contain information about secondary offices, ancillary services, alternate phone numbers, hours, prices, etc. In these instances, the information on the index card is printed transverse with respect to the orientation of the information relating to the addressee and the promotional message.

Alternately, the back side of the postcard can be the front side of the index card, or identical information can be printed on both sides. This has the advantage that it permits the tab to be on either the left or right side, depending on which side the user wants it, simply by flipping the index card over. In another embodiment, four angled corner slits may be provided in the index portion of the combination card to permit insertion of a business card by the recipient.

The combination mailer piece of this invention may be composed of any suitable sheet material, typically paper postcard or index card stock, or any special material such as specially printed stock, colored stock, plastic, mylar and the like. The tabs may be highlighted with special colors, fluorescent inks, raised ink, etc.

In an important embodiment, the composite cards of this invention may be printed four "up" on a standard 8½"×11" sheet of card stock paper, on A-4 card stock, on 8½"×14" card stock, or on any other convenient size. Considering the 8½ inch dimension of an 8½"×11" sheet of paper as being the "horizontal" dimension or axis, the four combination mailers of this invention are printed with the normal horizontal axis of the postcard being transverse to the paper sheet's horizontal dimension. That is, the normal typing axis of the index card is parallel to the horizontal dimension of the sheet of paper. The rectangular common margins of the four postcards may also be defined by micro perfs so that reams of the sheets may be printed (the index and informational portions pre-printed) and supplied to the mailer (sender) with blank address areas. These can then be fed into automated addressing equipment and sheet fed therethrough, or the individual cards may be separated (deboned from the sheets) and fed individually to addressing machines or label applying machines, or labels or addresses may be applied by hand (handwriting, typing, word processing). Where desired, e.g. for ease of processing in labeling/addressing equipment, the address may also be oriented parallel to the horizontal axis of the sheet (i.e., transverse to the normal orientation on a postcard. Likewise, the label or address and postage positions may be switched.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Referring now to FIGS. 1*a* and *b*, these two figures show the front side and back side of the combination mailer device 1 of this invention oriented in the "normal" horizontal position. That is, the long access of the postcard is oriented horizontally, in the usual orientation. The right side area 2 (defined between medial boundary 7 and the right marginal edge 19 of the mailer card 1) is reserved for address information in the area 3, and a postage stamp or postage meter imprint in the area 4. The left side 5 is defined between the left marginal edge 6 and a medial boundary 7 which may be a perforated line, a score, or a printed line or other means indicating an edge of an index card 8 which occupies a substantial portion of the left side of the mailer card. As shown in FIGS. 1*a* and *b*, the index card is oriented vertically, that is, with the normal writing axis being up and down. Of course, for chinese or other writing, the writing orientation would be rotated 90 degrees.

In the preferred embodiment, the index card is oriented so that one or more margins are coordinate with one or more margins of the postal mailer card. As seen in FIGS. 1*a* and *b*, an upper tab 9 has a margin 10 is coordinate with the left margin 6 of the postal mailer. The left margin of the index card 11 is coordinate with the upper margin 12 of the postal mailer card. As shown, the right margin 13 of the index card is defined by a series of perforations 14 which are spaced inwardly of the bottom margin 15 of the postal mailer card. However, it should be understood that the postal mailer card could be made of such size (vertical dimension) so that it is the same as the horizontal dimension of the index card. In that case, the right edge 13 of the index card would be coordinate with the bottom edge 15 of the mailer card and there would be no perfs 14 defining that edge.

As shown in FIGS. 1*a* and *b*, the upper edge 16 of the index card is spaced inwardly from the left marginal edge 6 of the postal mailer 1 to define a tab area 9 in the index card. This tab may be placed anywhere along the upper horizontal edge of the index card. It should be understood, however, that the tabs alternately could be placed along the right edge 13 or left edge 11 of the index card 8 as desired, following the same principles. It is preferred that the tab 9 be less than the full width of the card (between edges 11 and 13), and tabs of wider or narrower extent may be provided to yield a series of index cards with staggered tabs. It is preferred to use a 3 or 4 "cut" stagger on small index cards, and a 4 to 10 cut stagger on larger index cards.

The front, back or both sides of the index card may be preimprinted with information regarding the sender's name, address, services, or products. This printing is of course oriented vertically as seen in FIG. lb so that when the index card is placed properly in the index, the printing runs horizontally across the index card. The small outside corner portion chad 17 may be completely removed. Likewise, the T-shaped chads 18, 18' (see FIG. 1*a*) can be completely removed leaving corresponding holes for the index rails.

Figure 1B:
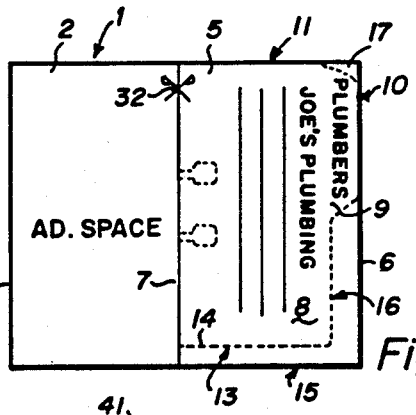
Figure 2:
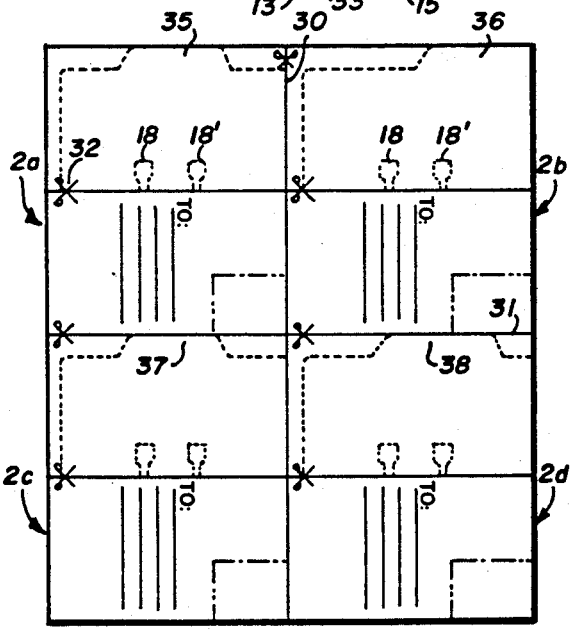
FIG. 2 shows four of the combination mailer cards of the invention oriented on a standard 8½"×11" sheet of paper (4-up on letter size)

FIG. 2 shows a four "up" orientation of the combination mailer of this invention. A single 8½"×11" or other size sheet of card stock paper can be divided into four cards along lines 30 and 31, which may be either printed lines, some sort of printed guide such as a scissor symbol or words 32, or perfed or scored for ease of separation of the individual combination mailers 2A, 2B, 2C and 2D therefrom. It is preferred that lines 30 and 31 be microperfs to provide smooth edges. Also shown in FIG. 2 is the provision of a "5-cut" tab arrangement in a single sheet of only 4 postcard/index card combination mailers. In card 2A, the index tab 35 is precisely centered. In 2B, the index tab 36 is on the right side shown from the face of the index card. However, when this card is turned over, the tab 36 then flips over to the left side. Compare the tab arrangements in FIGS. 1*a* and 1*b*, where the tab 9 in FIG. 1*a* is On the right whereas the same tab 9 is on the left in FIG. 1*b*. The index card of FIGS. 1*a* and 1*b* or FIG. 2 (combination card 2*b*) can be printed on both sides, thus providing for both a left and right tab orientation. The tabs 37 in card 2*c* and tab 38 in card 2*d* are intermediate, 37 being to the left of center and 38 being to the right of center. This provides a staggered set of cards. Separating along lines 30 and 31 yields four cards.

Figure 3:
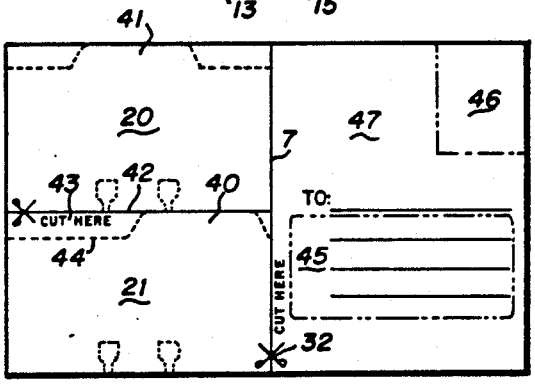
FIG. 3 shows the front of a standard size postcard with two small index cards oriented horizontally in a stacked arrangement.

FIG. 3 shows a "stacked" orientation in which two smaller index cards 20 and 21 are oriented horizontally, that is, parallel to the normal horizontal axis of the postcard as illustrated. This also illustrates a "3 cut" tab arrangement, in which the lower index card 21 with its tab portion 40 can serve as either a right or left orientation when printed on both sides, whereas, for the upper card 20 the tab portion 41 is the center tab position. In this embodiment the cut line 7 now forms the right edge of both cards, rather than the bottom. A separate cut line 42 forms the bottom margin of upper card 20 and a portion of the upper margin of card 21, the chad portion 43 being removable by tearing along the perf line 44 after cutting along the line 42 by the recipient.

Figure 4:
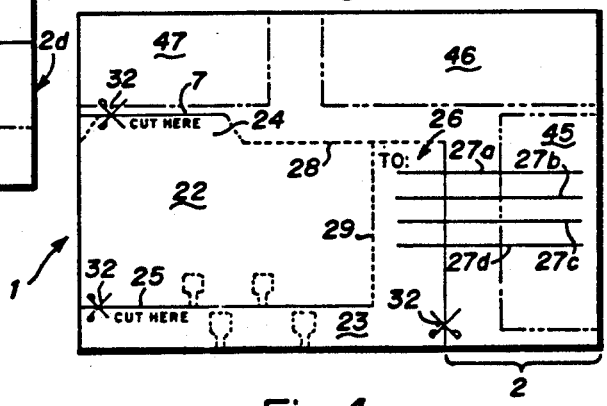
FIG. 4 shows the front of a standard postcard with a first larger (small or medium) index card presented horizontally, with provision for a vertical or horizontal address label and a postal meter imprint, as well as a smaller (mini or small) index card inset in the larger one.

FIG. 3 also shows the provision of an area 45 for a preaddressed label and an area 46 for a stamp or postal meter imprint extending into the adjacent area 47. It should be understood however that the address label 45 could be applied in a vertical orientation as shown in FIG. 4. Or, the address label could be placed along the upper right corner in the area 46 shown in FIG. 4, with the postage applied in the area 45 shown in FIG. 4. It should be understood that the normal orientation is for the postage to be in the area 46 in FIGS. 3 and 4, and the address being in area 45 in those two figures.

FIG. 4 also shows provision for a smaller index card 22 within a larger index card 23 oriented in the normal horizontal axis of the postcard. This permits the provision for an oversized or larger size index card 23 as well as the normal office size index card 22 in the same postcard, and the recipient can choose which to use. Because there is not a perf line at the bottom of inset card 22 (instead there is a cut line 25) the inset card 22 will not pull out of card 23 when card 23 is used in an index holder, e.g. a Rolodex unit. The ordinary "small" index card is 2⅛" to 2¼" high by 4" long (the "wide" or horizontal axis). This is the card 22 shown in FIG. 4. A medium sized card is on the order of 3" by 5" and this is shown as index card 23. Note that they both have a common tab 24 formed out of a common perf line 28 or combination perf 28 and cut line 7. The tab 24 functions as a left or right tab depending on which side of the combination mailer is printed with the information about the sender. Where only the smaller card 22 is used by the recipient, it is removed from the mailer by cutting along the lines 7 and 25 and tearing perfs 28 and 29.

In cases of larger index cards, either the large size of 4"×6" or the extra large size of 5×841, the dimensions of the combination mailer 1 will be enlarged to accommodate them. In that instance, partially in case of the extra large cards, they can be printed two up on a standard 8½"×11" sheet of paper with the area 2 reserved for the address as shown in FIG. 4 being approximately ½" wide, and the mailing label is then oriented vertically as shown in space 45 outlined by the dashed and dotted lines. In the alternative, in the case of the extra large card, the area 47 can be reserved for the postage while area 46 can be reserved for the address label or vice versa. Where the address label is at a normal position, as in space 45 or 46 shown in FIG. 4 it is preferred to have the instructional word "TO" 26 either adjacent the label or placed on the label itself. As noted, the instructional word "TO" 26 and the preprinted lines for the address 27*a* through 27*d* may actually run into some of the space of the medium or small sized index card 23. However, since there is only a small overlap this is not a serious disadvantage. Further, that can be on the back side of the index card and the preprinted information regarding the sender is on the obverse side of the combination mailer 1, that is, the side opposite the face shown in FIG. 4. Note also the scissor symbol 32 instructs the user to cut along the line.

Figure 5:
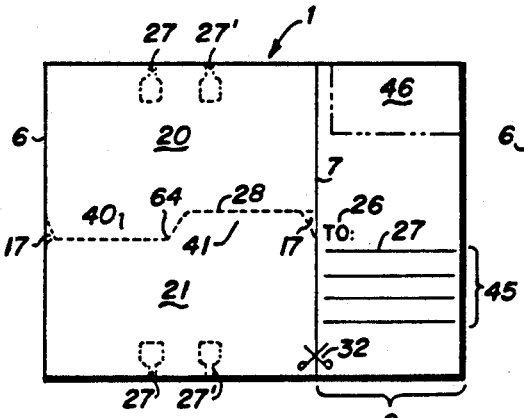
FIG. 5 shows two tabbed index cards in a post card oriented horizontally with their upper edge meeting along a common central perf line.

FIG. 5 is a presently preferred embodiment. This shows two horizontally oriented index cards 20 and 21, one upside down with respect to the other so that the tab areas 40 and 41 are formed by a common perf line 28 which extends inwardly from the left marginal edge 6 of the combination mailer 1 of this invention toward the vertical boundary line 7. In the proportions for a small index card, the area between vertical boundary line 7 and the left edge 6 of the postcard is 4", thus leaving a 1½" area 2 to the right of line 7 for the address 45 and postage 46. The height of the postal card is 4¼", thus permitting the exact spacing of two index cards of height 2⅛" without tabs. This is a standard small index card.

Figure 6:
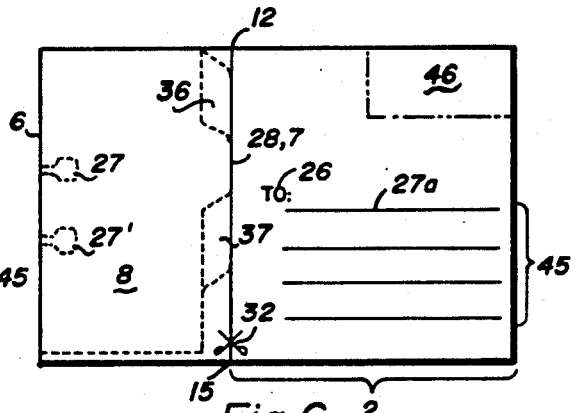
FIG. 6 shows another orientation of tabbed index cards, in this case vertical, with provision for a 3-cut tabbed orientation in only 2 different post cards.

FIG. 6 shows still another alternative with a standard 2¼" index card oriented vertically with the bottom along the left edge 6 of the postcard. As noted in both FIGS. 5 and 6, the die cut T-shaped notches 27, 27' all lead-in from their respective margins. The embodiment of FIG. 6 allows for more room for the address 26, 27 or address label 45 and a mailing label 46. Also note in the orientation in FIG. 6, there is room for more of a promotional message on the obverse side of area 2. It should also be understood that the tab 36 of the index card 8 in FIG. 6 can be disposed in a centered or intermediate location 37. Note common perf line 28 may be cut line 7 (preferred) extending from upper margin 12 (at point to bottom margin 15 (at point 15) or only as far as number 37. Currently, the embodiments of FIGS. 1*a*, 1*b*, 2 and 6 are the preferred embodiment for a small card having a main dimension of 2⅛"×4", with the top of the tab to the bottom dimension being 2½". The embodiment of FIG. 5 is the preferred embodiment for a card without a tab, or for a larger size mailer so tabs can be included.

Figure 7:
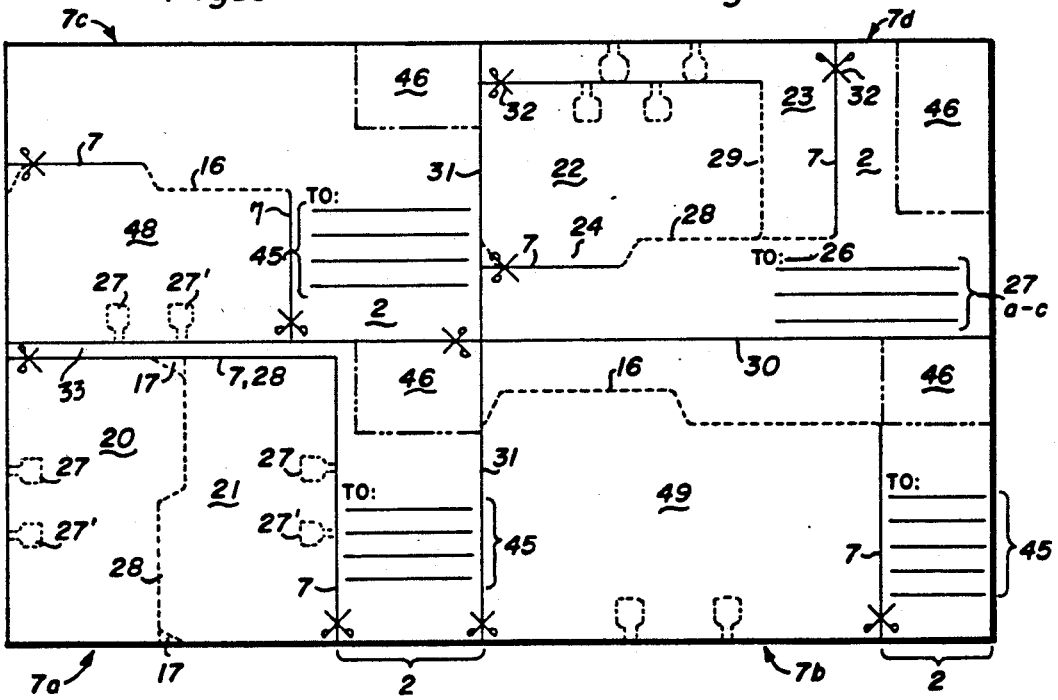
FIG. 7 shows a variety of a combination cards of this invention that may be oriented 4-up on an 8½"×14" sheet, including X-large cards.

Mailer 7*a* in FIG. 7 shows a vertical orientation of two cards 20 and 21, one of which is upside down with respect to the other, with a single perf line 28 defining the upper boundary of both, on larger 8½"×14" stock in a four up orientation. There is a ¼" marginal web 33 which for convenience is shown at the top of the postal card, but may be at the bottom. The address/postage 2 area on the right is 2" wide which provides enough room for either a horizontal or vertically oriented mailing label 45 and a postage stamp 46 as shown. Likewise this larger 8½"33 14" sheet can be used for the larger medium 3"×5" index cards 48 and the large 4"×6" index cards 49. For the 4"×6" card 49 as shown in mailer 7*b* of FIG. 7, of the mailing label is preferable oriented vertically (see FIG. 4) as there is only a 1" web area forming the right side portion 2. As shown in the card 7*c*, the medium size 3"×5" card may be oriented at the bottom left corner, offering a 2" web area 2 to the right in which it is easy to place the mailing label 45 and the postal meter imprint 46. Card area 7*d* is shown blank, but it should be understood that any of the variations of FIGS. 1–7 may be used, or cards of 7*a*, 7*b* or 7*c* repeated.

It should be understood that various modifications within the scope of this invention can be made by one of ordinary skill in the art without departing from the spirit thereof. For example, for extra heavy stock, or where the perfs are spaced along their run sufficiently (whether regular or micro perfs) to prevent bending or loss of the index card from the postcard, the printed or scored cut lines may be replaced with such appropriate (wide spaced) perfs. Likewise, the tab portion of the index card can be oriented so its top edge 10 is located along the vertical "cut line" 7 boundary between the right and left side areas of the post card. In this orientation the notches extend into the index card area from the left margin 6 of the postcard (as seen from the face of the postcard). As an alternative to four or more up on a single sheet, the postcards can be one or two wide and fan folded for feeding through computer operated printers, laser printers or the like. I therefore wish my invention to be defined by the scope of the appended claims as broadly as the prior art will permit, and in view of the specification if need be.

I claim:

1. A combination postcard/index card mailer piece comprising in operative combination:

(a) a mailer sheet of card-weight material having dimensions and weight permitting independent mailing to an index card user recipient without overwrap or insertion in an envelope, (b) said mailer sheet having a stop, a bottom, a left and a right marginal edge;

(c) said mailer sheet having a front face and a back face, a horizontal axis defining the normal orientation of an address on a postcard, and a vertical axis oriented perpendicular thereto, the dimensions of said horizontal axis being equal to or the longer than the dimension of said vertical axis;

(d) said mailer sheet front face being defined into at least two areas, a right side area and a left side area, and having means for defining a vertical boundary generally parallel to said vertical axis between said areas;

(e) said right side area being dimensioned of size sufficient to permit application of recipient index card user address information and postage;

(f) at least one index card area defined in said left side area of said mailer sheet, said index card having a top, a bottom, a left side and a right side margin;

(g) at least a portion of said index card margins being defined by perforations in said sheet which permit removal by hand of at least segments of said index card margins;

(i) said margins including at least one T-shaped notch extending into said index card area from said index card bottom margin, said notch being adapted to engage a rib on an index card holder assembly;

(h) said vertical boundary defining at least one edge of said index card lying to the left thereof said vertical boundary is at least in substantial part imperforate to provide sufficient strength along said boundary to prevent release of said index card from said mailer piece during printing and mailing;

(i) said index card having at least two portions of its marginal edges coordinate with at least portions of two edges of said postcard mailer piece; and (j) said index card being printable on at least one side with information from a sender, said information begin printable in user readable index card orientation, thereby to provide a preprinted index card to a recipient index card user addressee in postcard mailable format and cost.

2. A combination mailer piece as in claim 1 wherein:

(a) said left index card area contains a single index card.

3. A combination mailer piece as in claim 2 which is disposed as one of four-up mailable postcards in an 8½"×11" sheet of said card-weight material, and which mailer piece is oriented with its horizontal axis perpendicular or parallel to the normal horizontal orientation of said 8½41 ×11" sheet of paper.

4. A combination mailer piece as in claim 2 wherein:

(a) said single index card is oriented vertically with its readable information imprint direction parallel to said vertical boundary and perpendicular to said horizontal axis.

5. A combination mailer piece as in claim 4 wherein:

(a) the bottom margin of said single index card, except for said notch, is formed by said vertical boundary.

6. A combination mailer piece as in claim 5 wherein:

(a) said T-shaped notch is formed by perforations, and the area of said notch is removable as a chad.

7. A combination mailer piece as in claim 5 wherein:

(a) said T-shaped notch is completely die cut out to form a hole medial of the margins of said mailer card.

8. A combination mailer piece as in claim 4 wherein:

(a) the bottom margin of said single index card, except for said notch, is formed by the left edge of said mailable sheet.

9. A combination mailer piece as in claim 8 wherein:

(a) said T-shaped notch is formed by perforations, and the area of said notch is removable as a chad.

10. A combination mailer piece as in claim 4 wherein:

(a) said index card includes a tab forming a portion of its top boundary;

(b) said index card top margin includes at least one recessed portion, disposed inwardly into said mailer left side area and defined by perfs, so that said recessed portion is removable from said top margin to form said tab.

11. A combination mailer piece as in claim 1 wherein:

(a) said left side index card area includes at least two index cards.

12. A combination mailer piece as in claim 11 which is disposed as one of four-up mailable postcards in an 8½"×11" sheet of said card-weight material, and which mailer piece is oriented with its horizontal axis perpendicular or parallel to the normal horizontal orientation of said 8½"×11" sheet of paper.

13. A combination postcard/index card mailer piece, as in claim 11 wherein:

(a) said index cards are oriented horizontally or vertically with the normal information imprint direction transverse or parallel to said vertical boundary.

14. A combination mailer piece as in claim 13 wherein:

(a) at least two of said index cards include tabs formed in their top margins; and (b) said top margins of each are formed by a common perf line so that one of said cards is upside down with respect to the other and their tabs are offset.

15. A combination mailer piece as in claim 14 wherein:

(a) said T-shaped notch of one index card merges into the top edge of said mailer sheet, and said T-shaped notch of a second index card merges into the bottom edge of said mailer sheet; and (b) said T-shaped notches are defined by perforations, 16. A combination mailer piece as in claim 15 wherein:

(a) there are only two index cards defined in said index card areas;

(b) the bottom margin, except for said notches, and one side margin, of each said index card, is coordinate with the top and bottom edges and the left side edge, respectively of said mailer sheet; and (c) the remaining side margin of each of said index cards is said vertical boundary of said mailer sheet.

17. A combination mailer piece as in claim 16 wherein:

(a) said vertical boundary is formed by a line of at least partial printing, scoring, perfing, or combinations thereof, said perfing being insufficient to permit said index card area from being separated from said right side area during normal mail handling.

18. A combination mailer piece as in claim 17 which includes:

(a) a mailing label and/or postage disposed in said right side area.

19. A combination mailer piece as in claim 17 wherein:

(a) said index card is preprinted and said preprinting is disposed on at least one of said front and/or said back of said index card.

20. A combination mailer piece as in claim 1 which is disposed as one of four-up mailable postcards in an 8½"×11" sheet of said card-weight material, and which mailer piece is oriented with its horizontal axis perpendicular or parallel to the normal horizontal orientation of said 8½"×11" sheet of paper.

21. A combination postcard/index card mailer piece comprising in operative combination:

(a) a mailer sheet of direct mailcard-weight material having dimensions and weight permitting independent mailing to an index card user recipient without overwrap or insertion in an envelope, (b) said mailer sheet having a top, a bottom, a left and a right marginal edge;

(c) said mailer sheet having a front face and a back face, a horizontal axis defining the normal orientation of an address on a postcard, and a vertical axis oriented perpendicular thereto, the dimension of said horizontal axis being equal to or longer than the dimension of said vertical axis;

(d) said mailer sheet front face being defined into at least two areas, a right side area and a left side area, and having means for defining a vertical boundary generally parallel to said vertical axis between said areas;

(e) said right side area being dimensioned of size sufficient to permit application of recipient index card user address information and postage;

(f) one index card defined in said left side area of said mailer sheet, said index card having a top, a bottom, a left side and a right side margin;

(i) said single index card is oriented vertically with its readable information imprint direction parallel to said vertical boundary and perpendicular to said horizontal axis;

(ii) said index card includes a tab forming a portion of its top boundary;

(iii) said index card top margin includes at least one recessed portion, disposed inwardly into said mailer left side area and defined by perfs, so that said recessed portion is removable from said top margin to from said tab; and (iv) said tab top boundary is formed by a portion of the left edge of said mailer sheet;

(g) at least a portion of said index card margins being defined by perforations in said sheet which permit removal by hand of at least segments of said index card margins;

(i) said margins including at least one T-shaped notch extending into said index card area from said index card bottom margin, said notch being adapted to engage a rib on an index card holder assembly;

(h) said vertical boundary defining at least one edge of said index card lying to the left thereof;

(i) said index card having at least two portions of its marginal edges coordinate with at least portions of two edges of said postcard mailer piece; and (j) said index card being printable on at least one side with information from a sender, said information begin printable in user readable index card orientation, thereby to provide a preprinted index card to a recipient index card user addressee in postcard mailable format and cost.

22. A combination mailer piece as in claim 21 wherein:

(a) the bottom margin of said single index card, except for said notch, is formed by said vertical boundary; and (b) said T-shaped notch is formed by perforations, and the area of said notch is removable as a chad.

23. A combination mailer piece as in claim 21 which is disposed as one of four-up mailable postcards in an 8½"×11" sheet of said card-weight material, and which mailer piece is oriented with its horizontal axis perpendicular or parallel to the normal horizontal orientation of said 8½"×11" sheet of paper.

24. A combination postcard/index card mailer piece comprising in operative combination:

(a) a mailer sheet of direct mail card-weight material having dimensions and weight permitting independent mailing to an index card user recipient without overwrap or insertion in an envelope;

(b) said mailer sheet having a top, a bottom, a left and a right marginal edge;

(c) said mailer sheet having a front face and a back face, a horizontal axis defining the normal orientation of an address on a postcard, and a vertical axis oriented perpendicular thereto, the dimension of said horizontal axis being equal to or longer than the dimension of said vertical axis;

(d) said mailer sheet front face being defined into at least two areas, a right side area and a left side area, and having means for defining a vertical boundary generally parallel to said vertical axis between said areas;

(e) said right side area being dimensioned of size sufficient to permit application of recipient index card user address information and postage;

(f) at least one index card area defined in said left side area of said mailer sheet, said index card having a top, a bottom, a left side and a right side margin;

(g) at least a portion of said index card margins being defined by perforations in said sheet which permit removal by hand of at least segments of said index card margins;

(i) said margins including at least one T-shaped notch extending into said index card area from said index card bottom margin, said notch being adapted to engage a rib on an index card holder assembly;

(h) said vertical boundary defining at least one edge of said index card lying to the left thereof;

(i) said index card having at least two portions of its marginal edges coordinate with at least portions of two edges of said postcard mailer piece;

(j) said index card being printable on at least one side with information from a sender, said information being printable in user readable index card orientation, thereby to provide a preprinted index card to a recipient index car user addressee in postcard mailable format and cost;

(k) said left index card area includes a first, large index card oriented horizontally, and a second smaller index card inset within said first index card area, each index card having at least one said notch;

(l) at least two of said large index card margins, including the bottom margin of said large index card, except for said notches, being coordinate with the top, left or bottom edge of said mailer sheet, and one side margin of said large index card being coordinate with the left, top or bottom edge of said mailer sheet;

(m) the second side or top margin of said large index card being coordinate with at least a portion of said vertical boundary;

(n) said smaller index card having its top margin coordinate with at least a portion of the top margin of said larger index card, and at least one side margin coordinate with one side margin of said larger index card; and (o) at least one side or bottom margin, except for said T-shaped notches, of said smaller index being card defined by a printed, scored or perfed line.

25. A combination mailer piece as in claim 24 wherein:

(a) at least a portion of said common top margin of said index cards is formed of a perfed line.

26. A combination mailer piece as in claim 25 wherein:

(a) the T-shaped notches and bottom margin of said smaller index card are inset into the area of said larger index card; and (b) said T-shaped notches are die cut and the chads removable therefrom.

27. A combination mailer piece as in claim 26 which is disposed as one of four-up mailable postcards in an $8\frac{1}{2}'' \times 11''$ sheet of said card-weight material, and which mailer piece is oriented with its horizontal axis perpendicular or parallel to the normal horizontal orientation of said $8\frac{1}{2}'' \times 11''$ sheet of paper.

* * * * *